US007511729B2

(12) United States Patent
Hung

(10) Patent No.: US 7,511,729 B2
(45) Date of Patent: Mar. 31, 2009

(54) DRIVER CIRCUIT, CONTROL METHOD, AND RELATED THERMAL PRINT HEAD

(75) Inventor: Ming-Jiun Hung, Tai-Chung (TW)

(73) Assignee: Lite-On Technology Corp., Neihu, Taipei (TW)

( * ) Notice: Subject to any disclaimer, the term of this patent is extended or adjusted under 35 U.S.C. 154(b) by 421 days.

(21) Appl. No.: 11/306,660

(22) Filed: Jan. 5, 2006

(65) Prior Publication Data

US 2007/0085895 A1 Apr. 19, 2007

(30) Foreign Application Priority Data

Oct. 19, 2005 (TW) ..... 94136549 A

(51) Int. Cl.
*B41J 2/355* (2006.01)

(52) U.S. Cl. ..... 347/181; 347/182

(58) Field of Classification Search ..... 347/189, 347/181, 182; 400/120.05, 120.06
See application file for complete search history.

(56) References Cited

U.S. PATENT DOCUMENTS 6,570,601 B2 * 5/2003 Jimbo ..... 347/182

FOREIGN PATENT DOCUMENTS

JP H2-43060 2/1990
JP 6-340105 A 12/1994

* cited by examiner

*Primary Examiner*—Huan H Tran
(74) *Attorney, Agent, or Firm*—Winston Hsu

(57) ABSTRACT

A driver circuit of a thermal print head is disclosed including: a plurality of gating groups respectively coupled to a plurality of strobe signals of different timings in which each gating group includes a plurality of gate units respectively coupled to a plurality of heating elements; and a register module coupled to the plurality of gating groups for providing each gate unit with a corresponding color level data; wherein each gate unit controls a coupled heating element according to a corresponding strobe signal and a received color level data.

1 Claim, 6 Drawing Sheets

DRIVER CIRCUIT, CONTROL METHOD, AND RELATED THERMAL PRINT HEAD

BACKGROUND OF THE INVENTION

1. Field of the Invention

The present invention relates to thermal printing techniques, and more particularly, to driver circuits of a thermal sublimation/transfer printer, the control methods thereof and related thermal print heads.

2. Description of the Prior Art

In general, color printers can be classified into four major categories: dot matrix printers, inkjet printers, laser printers, and thermal sublimation (or thermal transfer) printers. Recently, the thermal sublimation printers have become increasingly popular due to their full tone printing performance. A thermal printer drives its thermal print head (TPH) to heat ribbons containing dyes. The dyes of the heated ribbon are transferred onto the object to be printed. By this way, continuous-tone can be formed on the object according to the length of the heating period or heating temperature.

Please refer to FIG. 1, which shows a schematic diagram of a conventional thermal print head 100. As shown, the thermal print head 100 is provided with a plural of driver circuits 110. Each driver circuit 110 loads printing data in accordance with an operating clock signal and then latches the loaded data under the control of a latch signal. Afterward, a strobe signal is employed in the thermal print head 100 to control each driver circuit 110 to drive plural coupled heating elements. Each heating element is arranged for heating an image dot, i.e., a pixel of the image to be printed. While the thermal print head 100 prints pixel data of a row, all driver circuits are controlled by the strobe signal to simultaneously drive corresponding heating elements. Therefore, considerable power consumption is required for supporting the operation of the thermal print head 100.

One conventional method for reducing the power consumption of the thermal print head 100 is to divide the image data of a same row into two parts: one part is composed of odd pixels while the other part is composed of even pixels. Then, the two parts are printed in turn. For example, the thermal print head 100 can firstly print odd pixels of a row and then print even pixels of the row after the odd pixels are completely printed. Such a printing method can reduce the required power consumption of the thermal print head 100, but it requires twice the printing time and increases the complexity of the firmware control of the thermal sublimation printer.

SUMMARY OF THE INVENTION

It is therefore an objective of the claimed invention to provide a method for controlling driver circuits of the thermal print head and related apparatuses to solve the above-mentioned problems.

An exemplary embodiment of a driver circuit of a thermal print head is disclosed comprising: a plurality of gating groups respectively coupled to a plurality of strobe signals of different timings in which each gating group includes a plurality of gate units respectively coupled to a plurality of heating elements; and a register module coupled to the plurality of gating groups for providing each gate unit with a corresponding color level data; wherein each gate unit controls a coupled heating element according to a corresponding strobe signal and a received color level data.

An exemplary embodiment of a method for controlling a driver circuit of a thermal print head is disclosed, wherein the driver circuit has a plurality of gating groups, and each gating group comprises a plurality of gate units. The disclosed method comprises: generating a plurality of strobe signals of different timings; and utilizing the plurality of strobe signals to respectively control the plurality of gating groups.

An exemplary embodiment of a thermal print head is also disclosed comprising: a strobe signal generator for generating a plurality of strobe signals of different timings; and a plurality of driver circuits coupled to the strobe signal generator in which each driver circuit comprises: a plurality of gating groups respectively coupled to the plurality of strobe signals in which each gating group includes a plurality of gate units respectively coupled to a plurality of heating elements; and a register module coupled to the plurality of gating groups for providing each gate unit with a corresponding color level data; wherein each gate unit controls a coupled heating element according to a corresponding strobe signal and a received color level data.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
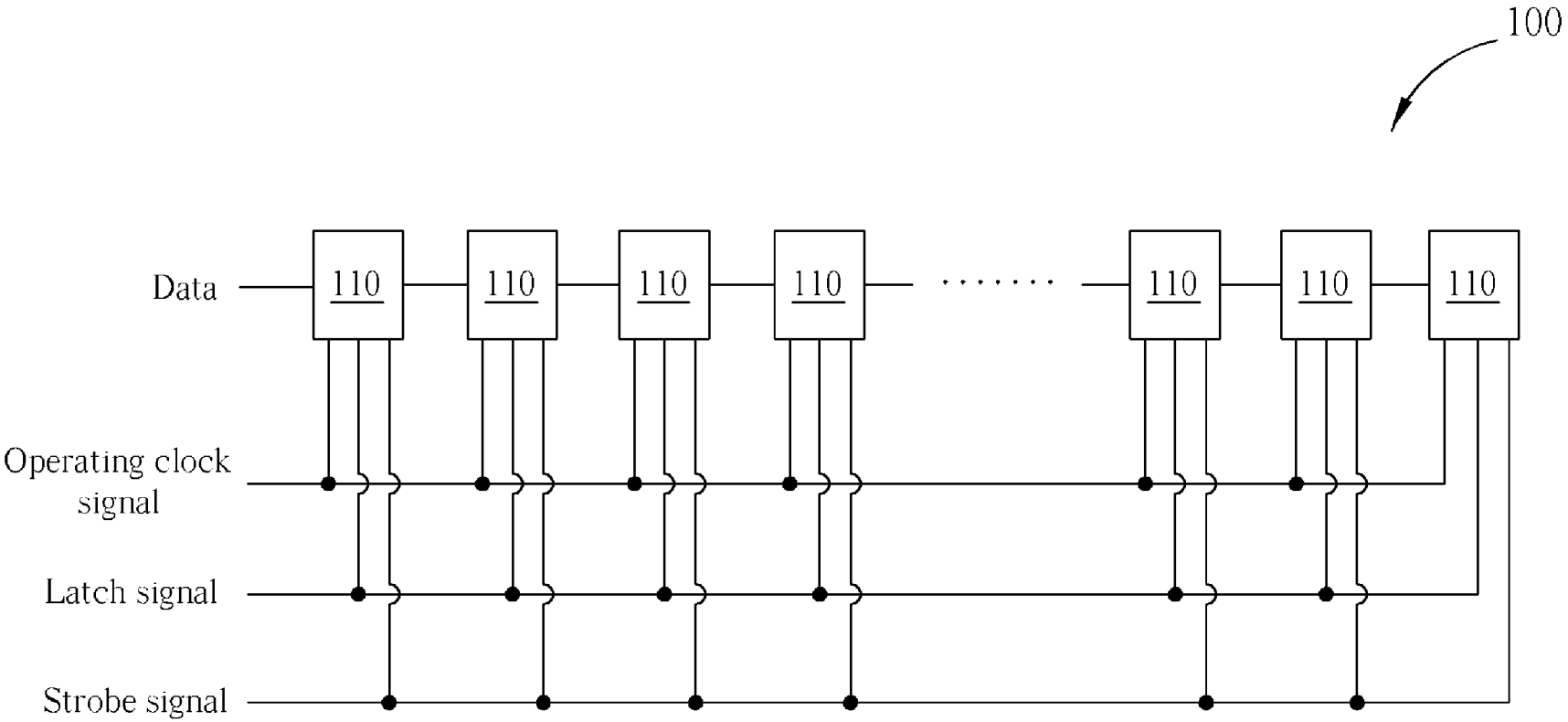
Fig. 1 Prior Art
FIG. 1 is a schematic diagram of a conventional thermal print head.
Figure 2:
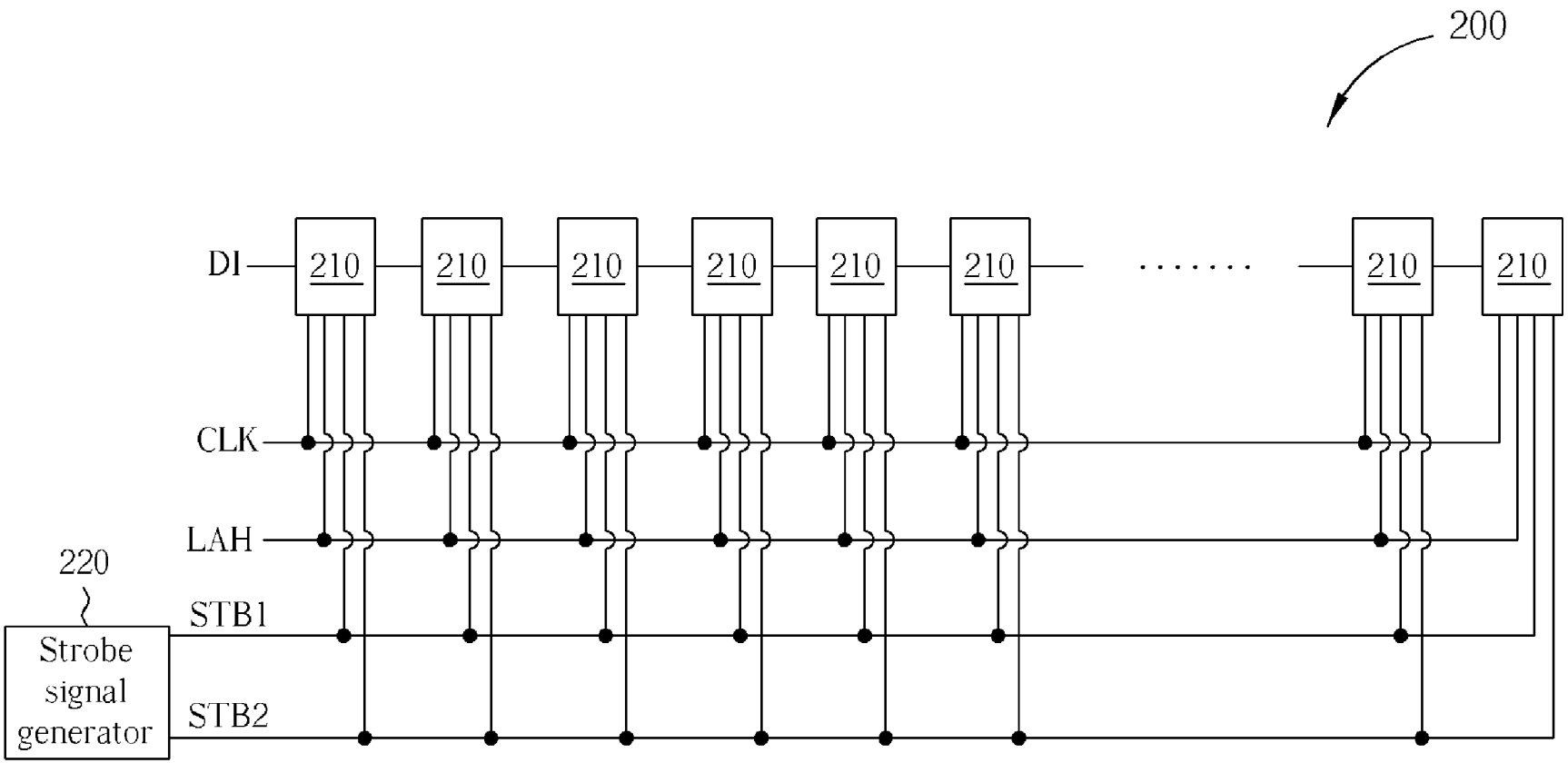
FIG. 2 is a schematic diagram of a thermal print head according to one embodiment of the present invention.

Please refer to FIG. 2, which shows a schematic diagram of a thermal print head 200 according to one embodiment of the present invention. In this embodiment, the thermal print head 200 comprises a plurality of driver circuits 210, and a strobe signal generator 220. Each driver circuit 210 is arranged for driving a plurality of heating elements (not shown). The strobe signal generator 220 is arranged for generating a first strobe signal STB1 and a second strobe signal STB2 in which the timings of the first and second strobe signals STB1 and STB2 are different. As shown in FIG. 2, both the first strobe signal STB1 and the second strobe signal STB2 are coupled to every driver circuit 210 of the thermal print head 200.

In addition, each driver circuit of the thermal print head 200 is also coupled to an operating clock signal CLK and a latch signal LAH. The operating clock signal CLK is employed to control the timing of loading of print data D1 into each driver circuit 210. After the print data are loaded into those driver circuits, the latch signal LAH controls each driver circuit 210 to latch the loaded data. The operating clock signal CLK and the latch signal LAH are typically generated by a control circuit of a thermal sublimation printer applying the thermal print head 200. Generation of the operating clock signal CLK and the latch signal LAH are well known in the art, and further details are therefore omitted herein for brevity. In this embodiment, the latch signal LAH, the first strobe signal STB1, and the second strobe signal STB2 are low active, but this is merely an example rather than a restriction of the practical implementations.

Figure 3:
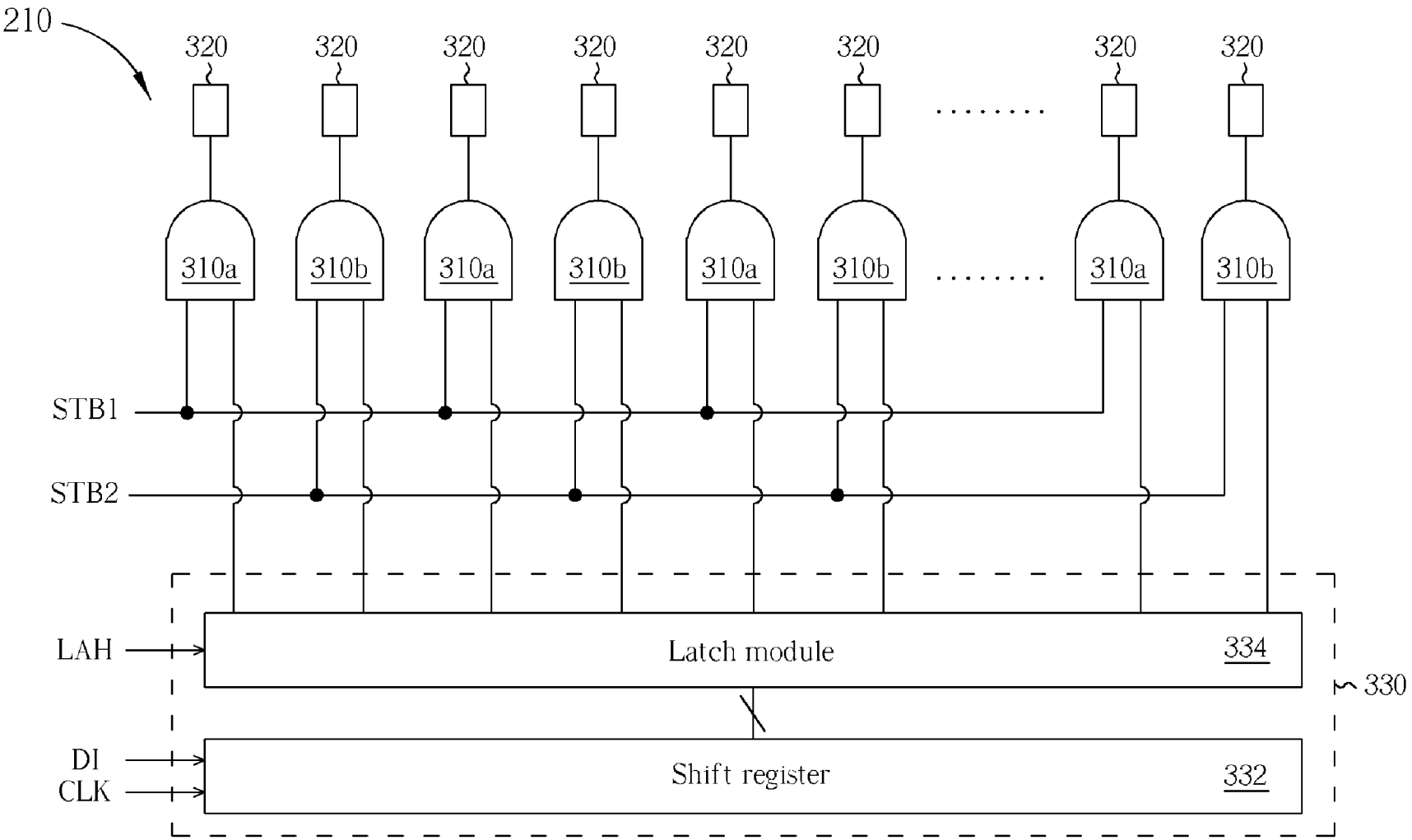
FIG. 3 is a simplified block diagram of a driver circuit of FIG. 2 according to one embodiment of the present invention.
Figure 4:
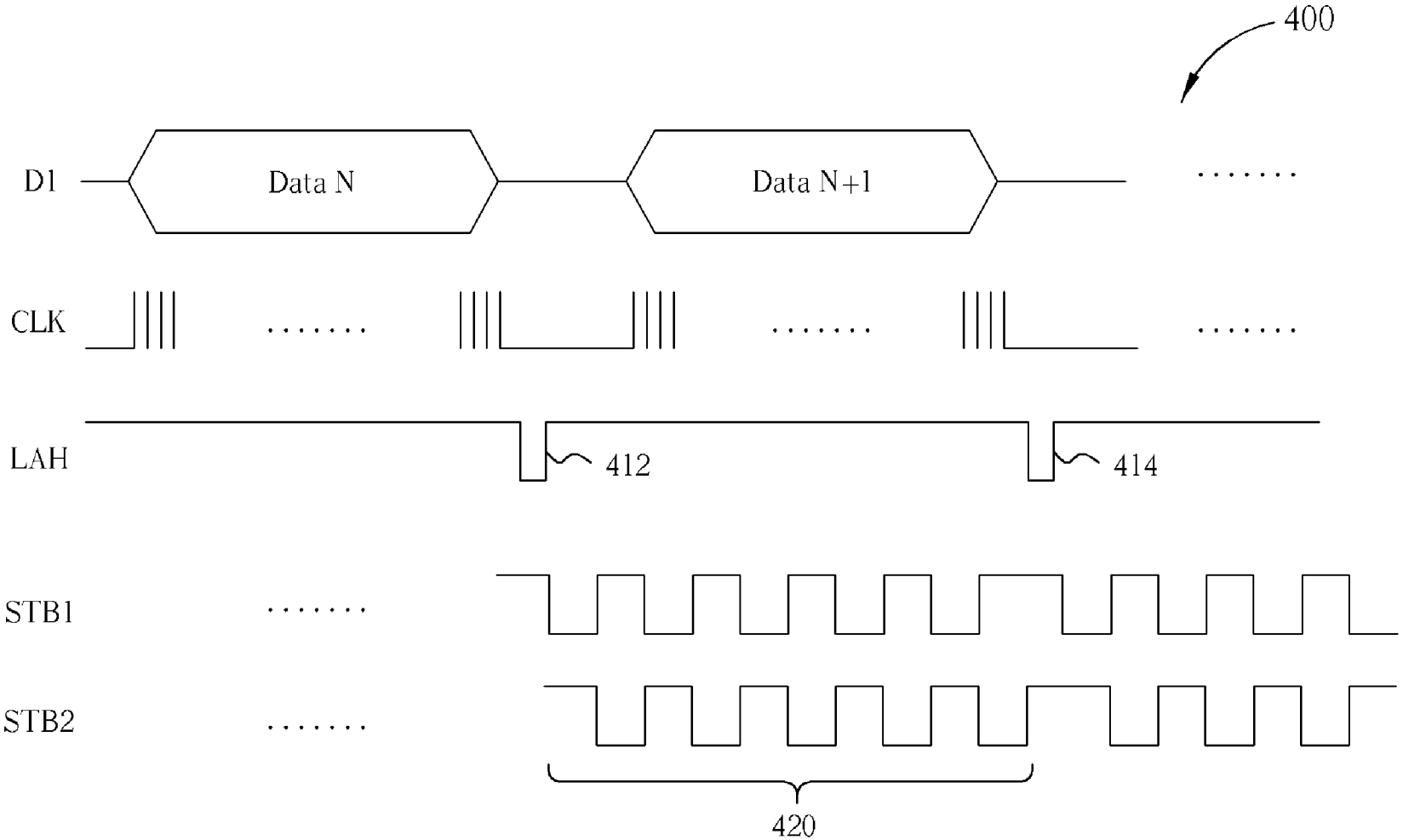
FIG. 4 is a timing diagram illustrating the operation of the driver circuit of FIG. 3 according to an exemplary embodiment of the present invention.

Please refer to FIG. 3 and FIG. 4. FIG. 3 shows a simplified block diagram of the driver circuit 210 according to an exemplary embodiment of the present invention. FIG. 4 depicts a timing diagram 400 of the driver circuit 210 according to a preferred embodiment of the present invention. As shown in FIG. 3, the driver circuit 210 comprises a plurality of gate units 310 for respectively controlling a plurality of heating elements 320; and a register module 330 coupled to all the gate units 310. The register module 330 is arranged for receiving print data DI in accordance with the operating clock signal CLK and for providing each gate unit 310*a* with corresponding color level data. In each driver circuit 210, some gate units 310 are coupled to the first strobe signal STB1 while the other gate units 310 are coupled to the second strobe signal STB2. In each driver circuit 210, if the gate units coupling to the same strobe signal are regarded as a gating group, then there are multiple gating groups in the driver circuit 210. In practice, the amount of gate units coupling to each strobe signal can be designed to be the same to obtain better power efficiency.

In this embodiment, for example, the first strobe signal STB1 is coupled to all the odd gate units 310 of the driver circuit 210, and the second strobe signal STB2 is coupled to all the even gate units 310 of the driver circuit 210. For the purpose of explanatory convenience in the following description, the gate units 310 coupling to the first strobe signal STB1 are labeled with 310*a*, and the gate units 310 coupling to the second strobe signal STB2 are labeled with 310*b*. As mentioned above, a plurality of gate units 310*a* coupling to the first strobe signal STB1 can be regarded as a first gating group, and a plurality of gate units 310*b* coupling to the second strobe signal STB2 can be regarded as a second gating group.

As shown in FIG. 3, the register module 330 of this embodiment comprises a shift register 332 and a latch module 334. Color level data of the print data DI are loaded to the shift register 332 together with the operating clock signal CLK. As shown in FIG. 4, the latch module 334 latches the color level data N loaded into the shift register 332 according to an active pulse 412 of the latch signal LAH, and output a corresponding color level data to each of the gate units 310*a* and 310*b*. During a heating period 420 corresponding to the color level data N, the first gating group controls corresponding odd heating elements 320 according to the first strobe signal STB1, and the second gating group controls corresponding even heating elements 320 according to the second strobe signal STB2. In one embodiment, the heating duration of each heating element 320 is determined by the color level of the corresponding pixel, and the heating temperature of the heating element 320 is controlled by the corresponding strobe signal.

If the heating element 320 continuously heats for too long, it will burn out. To avoid this, both the first and second strobe signals STB1 and STB2 control coupled gate units 310 with clock pulses as shown in FIG. 4. As mentioned above, the first strobe signal STB1 and the second strobe signal STB2 of this embodiment are low active. Accordingly, when the first strobe signal STB1 is at high level, all the gate units 310*a* of the first gating group do not enable any heating element. When the first strobe signal STB1 is at low level, each gate unit 310*a* of the first gating group determines whether or not to enable the connected heating element 320 according to the received color level data. Similarly, when the second strobe signal STB2 is at high level, all the gate units 310*b* of the second gating group do not enable any heating element. When the second strobe signal STB2 is switched to low level, each gate unit 310*b* of the second gating group determines whether or not to enable the connected heating element 320 according to the received color level data. In other words, each gate unit 310 of the driver circuit 210 controls a coupled heating element 320 according to a corresponding strobe signal and a received color level data.

In this embodiment, the strobe signal generator 220 alternately set the first strobe signal STB1 and the second strobe signal STB2 to an active level during the heating period 420. In other words, the first strobe signal STB1 and the second strobe signal STB2 are not at the low level at the same time within the heating period 420. Accordingly, the first and second gating groups alternately operate during the heating period 420, so that at most half of the heating elements 320 of the driver circuit 210 perform heating operation simultaneously. As a result, the required power consumption of the driver circuit 210 can be significantly reduced.

Note that the pulse number of the first strobe signal STB1 and the second strobe signal STB2 shown in FIG. 4 is merely an embodiment rather than a restriction of the practical implementations.

During the heating operations in accordance with the color level data N, the thermal print head 200 can start to load the next color level data (i.e., color level data N+1) into the shift register 332 of each driver circuit 210. When the heating operation for the color level data N is completed, the latch module 334 of each driver circuit 210 latches the newly loaded color level data N+1 according to an active pulse 414 of the latch signal LAH. As a result, the thermal print head 200 can immediately start the heating operation for the color data N+1 after the heating operation for the color data N is finished.

As described in the foregoing, for each driver circuit 210, at most half of the heating elements 320 perform heating operation simultaneously at any time. Accordingly, it can be derived that at most half of the heating elements 320 of the thermal print head 200 perform heating operation simultaneously. In contrast to the prior art, the disclosed architecture of the driver circuit 210 is capable of significantly reducing the required power consumption to one half of the power consumption of the prior art without decreasing the printing speed.

Please note that the number of strobe signals generated by the strobe signal generator 220 is not limited to two as in the foregoing embodiment. In practice, the strobe signal generator 220 may generate three or more strobe signals of different timings and utilize the strobe signals to control different gating groups of each driver circuit 210. The power consumption of the thermal print head 200 can be reduced, if any one of the strobe signals does not completely overlap the active period of another strobe signal.

Figure 5:
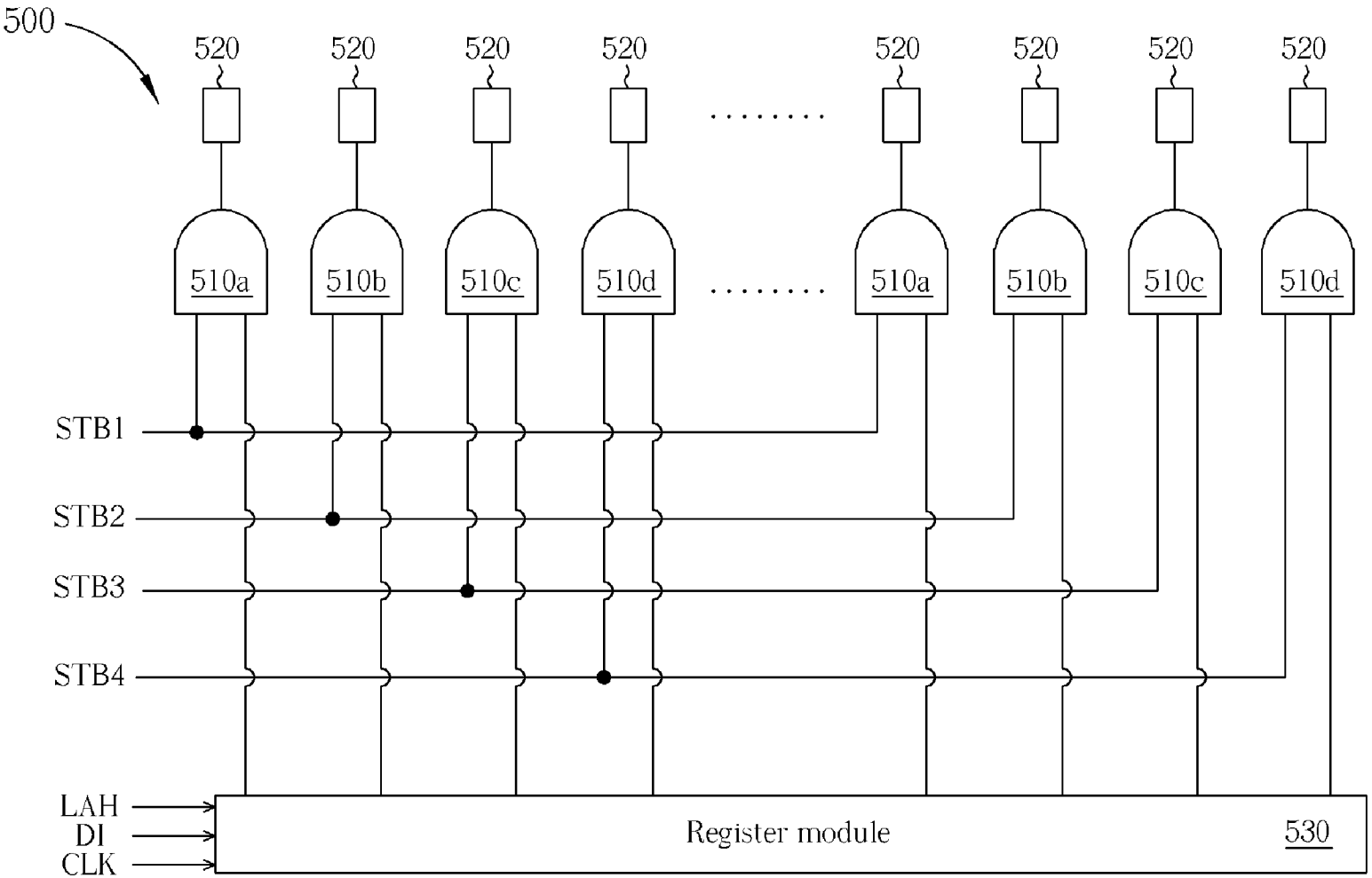
FIG. 5 is a simplified block diagram of a driver circuit according to another embodiment of the present invention.

By way of example, FIG. 5 shows a simplified block diagram of a driver circuit 500 according to another embodiment of the present invention. As shown, the driver circuit 500 comprises a plurality of gate units 510 for respectively controlling a plurality of heating elements 520; and a register module 530 coupled to all the gate units 510. In this embodiment, the plurality of gate units 510 of the driver circuit 500 are divided into four gating groups, which are coupled to a first strobe signal STB1, a second strobe signal STB2, a third strobe signal STB3, and a fourth strobe signal STB4 of different timings, respectively. The first, second, third, and fourth strobe signals are generated by a strobe signal generator (not shown). In FIG. 5, for the purpose of explanatory convenience in the following description, the gate units 510 coupling to the first strobe signal STB1 are labeled with 510*a*, the gate units 510 coupling to the second strobe signal STB2 are labeled with 510*b*, the gate units 510 coupling to the third strobe signal STB3 are labeled with 510*c*, and the gate units 510 coupling to the fourth strobe signal STB4 are labeled with 510*d*.

Figure 6:
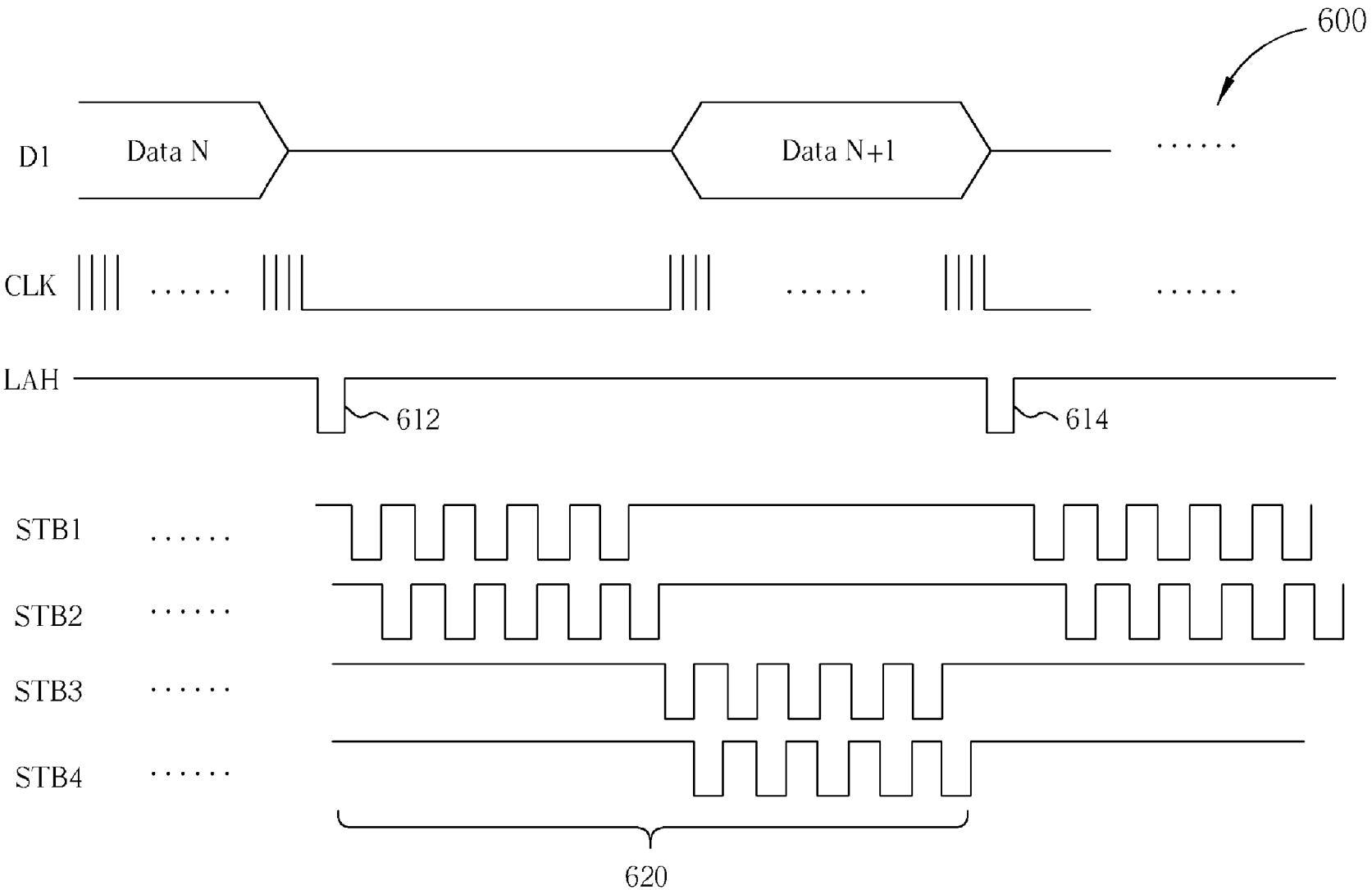
FIG. 6 is a timing diagram illustrating the operation of the driver circuit of FIG. 5 according to an exemplary embodiment of the present invention.

Please refer to FIG. 6, which depicts a timing diagram 600 of the driver circuit 500 according to a preferred embodiment of the present invention. Similar to the foregoing embodiment, the register module 530 latches the loaded color level data N of the print data DI according to an active pulse 612 of the latch signal LAH, and provides a corresponding color level data for each gate unit 510. The operations and implementations of the register module 530 are substantially the same as the disclosed register module 330, and further details are therefore omitted for brevity. Then, the four gating groups of the driver circuit 500 operate under the control of the four strobe signals STB1, STB2, STB3, and STB4, respectively. In each gating group, all the gate units operate according to the strobe signal corresponding to the gating group. For example, during a heating period 620 corresponding to the color level data N, each gate unit 510*a* controls a coupled heating elements 520 according to the first strobe signal STB1 and a received color level data; each gate unit 510*b* controls a coupled heating elements 520 according to the second strobe signal STB2 and a received color level data; each gate unit 510*c* controls a coupled heating elements 520 according to the third strobe signal STB3 and a received color level data; and each gate unit 510*d* controls a coupled heating elements 520 according to the fourth strobe signal STB4 and a received color level data.

If the active level period of a strobe signal is too short, then the heating temperature of the corresponding heating elements 520 may be insufficient. To avoid this situation, the first and second strobe signals STB1 and STB2 of this embodiment are alternately set to an active level during the former half of the heating period 620 and the third and fourth strobe signals STB3 and STB4 are alternately set to an active level during the later half of the heating period 620 as shown in FIG. 6. Therefore, there is merely one of the four strobe signals being set to the active level at any time point within the heating period 620. By adopting this control scheme, the time required for printing a row is roughly twice that required by the foregoing thermal print head 200, but the required power consumption can be further reduced to one half the power consumption required by the thermal print head 200.

Similarly, the register module 530 of the driver circuit 500 can start to load the next color level data (i.e., color level data N+1) during the heating operations in accordance with the color level data N. When the heating operation for the color level data N is completed, the register module 530 latches the newly loaded color level data N+1 according to an active pulse 614 of the latch signal LAH. As a result, the thermal print head can immediately start the heating operation for the color data N+1 after the heating operation for the color data N is done.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A thermal print head comprising:

a strobe signal generator for generating a plurality of strobe signals of different timings; and a plurality of driver circuits coupled to the strobe signal generator, each driver circuit comprising:

a plurality of gating groups respectively coupled to the plurality of strobe signals in which each gating group includes a plurality of gate units respectively coupled to a plurality of heating elements; and a register module coupled to the plurality of gating groups for providing each gate unit with a corresponding color level data;

wherein each gate unit controls a coupled heating element according to a corresponding strobe signal and a received color level data.

* * * * *